US008893826B2

(12) United States Patent
Desai

(10) Patent No.: US 8,893,826 B2
(45) **Date of Patent: *Nov. 25, 2014**

(54) OPTIMIZED REAMING SYSTEM BASED UPON WEIGHT ON TOOL

(71) Applicant: Smith International, Inc., Houston, TX (US)

(72) Inventor: Praful C. Desai, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/709,894

(22) Filed: Dec. 10, 2012

(65) Prior Publication Data

US 2013/0098682 A1 Apr. 25, 2013

Related U.S. Application Data

(63) Continuation of application No. 12/499,674, filed on Jul. 8, 2009, now Pat. No. 8,327,954, which is a continuation-in-part of application No. 12/170,158, filed on Jul. 9, 2008, now Pat. No. 7,699,120.

(51) Int. Cl.

| | |
|---|---|
| ***E21B 7/28*** | (2006.01) |
| ***E21B 10/32*** | (2006.01) |
| ***E21B 44/00*** | (2006.01) |

(52) U.S. Cl.

CPC . *E21B 44/00* (2013.01); *E21B 7/28* (2013.01); *E21B 10/32* (2013.01); *E21B 10/322* (2013.01)

USPC ..... 175/263; 175/24; 175/317; 175/267

(58) Field of Classification Search

USPC ..... 175/38, 231, 267, 290, 317

See application file for complete search history.

(56) References Cited

U.S. PATENT DOCUMENTS

| | | | | |
|---|---|---|---|---|
| 2,822,150 | A | 2/1958 | Muse et al. | |
| 2,899,000 | A * | 8/1959 | Medders et al. | 166/55.8 |
| 4,784,223 | A | 11/1988 | Worrall et al. | |

(Continued)

FOREIGN PATENT DOCUMENTS

| | | | |
|---|---|---|---|
| EP | 0568292 | A1 | 11/1993 |
| GB | 2397839 | A | 8/2004 |

(Continued)

OTHER PUBLICATIONS

Independent Search Report regarding U.S. Appl. No. 12/499,674 and Patent # 7,699,120 dated Feb. 27, 2009. 12 pages.

(Continued)

*Primary Examiner* — Jennifer H Gay
*Assistant Examiner* — Elizabeth Gitlin
(74) *Attorney, Agent, or Firm* — Osha Liang LLP

(57) ABSTRACT

A drilling apparatus includes a tubular body including an upper connection and a lower connection with a drill bit disposed thereon, and an axial borehole therethrough, wherein the upper connection is configured to attach to a drillstring, primary cutter blocks coupled to the tubular body and configured to selectively expand radially therefrom. The drilling apparatus further includes backup cutter blocks coupled to the tubular body and configured to selectively expand radially therefrom, and an activation system configured to selectively expand and collapse the primary and backup cutter blocks in response to changes in weight applied to the primary and backup cutter blocks.

18 Claims, 8 Drawing Sheets

(56) References Cited

U.S. PATENT DOCUMENTS

| | | | | |
|---|---|---|---|---|
| 5,036,921 | A * | 8/1991 | Pittard et al. | 166/298 |
| 5,074,355 | A * | 12/1991 | Lennon | 166/55.1 |
| 5,368,114 | A | 11/1994 | Tandberg et al. | |
| 5,526,884 | A | 6/1996 | Lembcke | |
| 5,558,153 | A | 9/1996 | Holcombe et al. | |
| 5,560,426 | A | 10/1996 | Trahan et al. | |
| 5,732,776 | A | 3/1998 | Tubel et al. | |
| 5,853,054 | A | 12/1998 | McGarian et al. | |
| 6,006,832 | A | 12/1999 | Tubel et al. | |
| 6,041,857 | A | 3/2000 | Carmody et al. | |
| 6,241,028 | B1 | 6/2001 | Bijleveld et al. | |
| 6,364,037 | B1 | 4/2002 | Brunnert et al. | |
| 6,612,547 | B2 | 9/2003 | Carmody et al. | |
| 6,659,200 | B1 | 12/2003 | Eppink | |
| 6,702,025 | B2 | 3/2004 | Meaders | |
| 6,732,817 | B2 | 5/2004 | Dewey et al. | |
| 6,736,213 | B2 | 5/2004 | Bussear et al. | |
| 6,873,267 | B1 | 3/2005 | Tubel et al. | |
| 6,926,089 | B2 | 8/2005 | Goodson, Jr. et al. | |
| 6,929,076 | B2 | 8/2005 | Fanuel et al. | |
| 6,994,172 | B2 | 2/2006 | Ray | |
| 7,036,611 | B2 | 5/2006 | Radford et al. | |
| 7,150,318 | B2 | 12/2006 | Freeman | |
| 7,156,181 | B2 | 1/2007 | Moore et al. | |
| 7,159,662 | B2 | 1/2007 | Johansen et al. | |
| 7,201,230 | B2 | 4/2007 | Schultz et al. | |
| 7,252,152 | B2 | 8/2007 | LoGiudice et al. | |
| 7,308,937 | B2 | 12/2007 | Radford et al. | |
| 7,314,099 | B2 | 1/2008 | Dewey et al. | |
| 7,316,277 | B2 | 1/2008 | Jeffryes | |
| 7,328,755 | B2 | 2/2008 | Hall et al. | |
| 7,337,850 | B2 | 3/2008 | Contant | |
| 7,426,964 | B2 | 9/2008 | Lynde et al. | |
| 7,430,153 | B2 | 9/2008 | Fraser et al. | |
| 7,434,613 | B2 | 10/2008 | Restarick et al. | |
| 2001/0054505 | A1 | 12/2001 | Carmody et al. | |
| 2003/0155155 | A1 | 8/2003 | Dewey et al. | |
| 2004/0251027 | A1 | 12/2004 | Sonnier et al. | |
| 2006/0096786 | A1 | 5/2006 | Wells | |
| 2006/0118304 | A1 | 6/2006 | Ohmer | |
| 2006/0207797 | A1 | 9/2006 | Dewey et al. | |
| 2007/0056724 | A1 | 3/2007 | Spring et al. | |
| 2008/0115574 | A1 | 5/2008 | Meek | |
| 2008/0128169 | A1 | 6/2008 | Radford et al. | |

FOREIGN PATENT DOCUMENTS

| | | | |
|---|---|---|---|
| GB | 2439234 | A | 12/2007 |
| GB | 2461632 | A | 1/2010 |
| WO | 2008/150290 | A1 | 12/2008 |

OTHER PUBLICATIONS

UKIPO's Combined Search and Examination report for corresponding UK patent application # GB0911704.5 dated Oct. 12, 2009. 6 pages.

Combined Search and Examination Report issued in related British patent application No. GB1010946.0; Dated Jul. 23, 2010 (5 pages).

Examination Report issued in corresponding British Patent Application No. GB1010946.0; Dated Jun. 27, 2011 (2 pages).

Office Action issued in related U.S. Appl. No. 12/499,674; Dated Feb. 29, 2012 (8 pages).

Office Action issued in related U.S. Appl. No. 12/694,489; Dated Nov. 29, 2012 (10 pages).

* cited by examiner

OPTIMIZED REAMING SYSTEM BASED UPON WEIGHT ON TOOL

RELATED APPLICATIONS

The present application is a continuation application, and claims benefit pursuant to 35 U.S.C. §120 of U.S. patent application Ser. No. 12/499,674, filed on Jul. 8, 2009, now U.S. Pat. No. 8,327,954, which is a continuation-in-part of U.S. patent application Ser. No. 12/170,158, filed Jul. 9, 2008, now U.S. Pat. No. 7,699,120, both of which are incorporated by reference in their entireties.

BACKGROUND

1. Field of the Disclosure

Embodiments disclosed herein relate generally to an activation system for a drilling apparatus. In particular, embodiments disclosed herein relate to an activation mechanism of a drilling apparatus to selectively open and close multiple cutter blocks of the drilling apparatus.

2. Background Art

In the drilling of oil and gas wells, concentric casing strings may be installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas may be reduced. Therefore, to increase the annular space for the cementing operation, and to increase the production flow area, it may be desirable to enlarge the borehole below the terminal end of the previously cased borehole. In "hole enlargement while drilling" operations ("HEWD"), the borehole is enlarged to provide a larger annular area for subsequently installing and cementing a larger casing string. Accordingly, by enlarging the borehole below the previously cased borehole, the bottom of the formation may be reached with comparatively larger diameter casing, thereby providing more flow area for the production of oil and gas.

Various methods have been devised for passing a drilling assembly, either through a cased borehole or in conjunction with expandable casing to enlarge the borehole. One such method involves the use of expandable cutter blocks, which has basically two operative states. A closed or collapsed state may be configured where the diameter of the tool is sufficiently small to allow the tool to pass through the existing cased borehole, while an open or partly expanded state may be configured where one or more arms with cutters on the ends thereof extend from the body of the tool. In the latter position, the cutter blocks enlarge the borehole diameter as the tool is rotated and lowered in the borehole. During HEWD operations, depending upon operational requirements of the drilling assembly, cutter blocks may be extended or retracted while the assembly is downhole.

Movement of the cutter blocks typically involves manipulating a sleeve that is used to open or close ports to allow fluid to activate and expand the cutter blocks. In certain prior art applications, the sleeve is held in place with shear pins, and a ball drop device may be used to shear the pins by increasing pressure in the tool to move the sleeve and open the cutter block activation ports. However, once the pins are sheared, the tool stays open for the duration of the drilling interval as long as there is pressure in the tool bore. Therefore, such a configuration may only allow one open cycle. This is also applicable to other tools which may be expanded, including but not limited to, cutting tools, spearing tools, and expandable stabilizers.

In HEWD operations, the weight on the cutter blocks and the weight on the drill bit may vary depending upon the type of formation in which the bit and cutter blocks are in at any given time. For example, because the cutter blocks may be located up to 60 feet away from the distal end of the drillstring (upon which the drill bit is attached), the drill bit may be in a softer formation while the cutter blocks are in a harder formation. In this case, the cutter blocks may carry excessive amounts of weight, which may cause cutters on the cutter blocks to wear prematurely. As a result, the rate of penetration through the formation slows down. Currently, warning information may be provided to the operator prior to the drilling operation showing particular intervals in the formation that have an increased hardness. This requires preliminary well information to be obtained prior to the drilling operation. From this information, the operator then knows to pass through that interval with care and ease up on the weight on the reamer in order to not wear the cutter blocks prematurely.

Accordingly, there exists a need for an apparatus and method to compensate for differences in weight on the drill bit and cutter blocks to prevent premature wear of the cutter blocks while maintaining a normal and adequate rate of penetration ("ROP") through the formation.

SUMMARY OF THE DISCLOSURE

In one aspect, embodiments disclosed herein relate to a drilling apparatus including a tubular body including an upper connection and a lower connection with a drill bit disposed thereon, and an axial borehole therethrough, wherein the upper connection is configured to attach to a drillstring, primary cutter blocks coupled to the tubular body and configured to selectively expand radially therefrom, backup cutter blocks coupled to the tubular body and configured to selectively expand radially therefrom, and an activation system configured to selectively expand and collapse the primary and backup cutter blocks in response to changes in weight applied to the primary and backup cutter blocks.

In other aspects, embodiments disclosed herein relate to a method of selectively activating cutter blocks in a drilling apparatus, wherein the drilling apparatus includes a tubular body with an axial borehole therethrough, the method including actuating an activation system, providing fluid communication through an activation port in a main sleeve to a primary cutter block activation port and expanding primary cutter blocks, detecting an increased weight applied to the primary cutter blocks, operating the main sleeve to provide fluid communication to a backup cutter block activation port and expand backup cutter blocks when an increased weight is detected on the primary cutter blocks, and collapsing the primary cutter blocks.

Other aspects and advantages of the invention will be apparent from the following description and the appended claims.

DETAILED DESCRIPTION

In one aspect, embodiments disclosed herein relate to an activation system and related methods used in a drilling apparatus to selectively open and close expandable cutter blocks of the drilling apparatus. In particular, embodiments disclosed herein relate to methods and apparatus capable of selectively actuating primary and backup cutter blocks during downhole borehole enlarging operations.

Figure 1A:
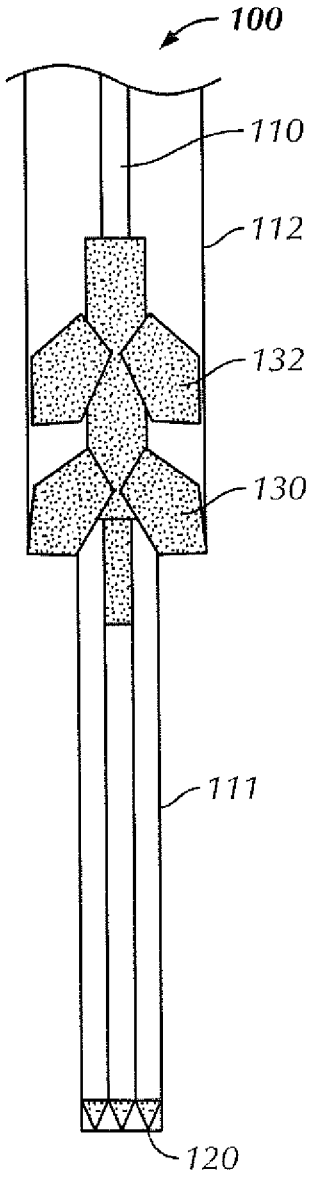
FIG. 1A is a cross-section view of a drilling apparatus in accordance with embodiments of the present disclosure.

Referring to FIG. 1A, a cross-section view of a drilling apparatus 100 is shown in accordance with embodiments of the present disclosure. Drilling apparatus 100 includes a drillstring 110 having a drill bit 120 disposed on an end thereof, which drills a pilot hole 111. Drilling apparatus 100 further includes primary cutter blocks 130 and backup cutter blocks 132, which are configured to drill an enlarged borehole 112 along the same path as the pilot hole 111. The cutter blocks are well known in the art and typically include cutting elements and a stabilizer pad (not shown). The primary and backup cutter blocks are configured to travel along grooves (not shown) formed in the body of the drilling apparatus 100 when expanded or collapsed.

The backup cutter blocks 132 may be constructed to be heavier duty than the primary cutter blocks 130 to withstand cutting in harder formations, and thereby handle more weight. In particular, the backup cutter blocks may be more robust by adding extra rows of cutters, using larger size cutters, using more robust cutting materials, varying the cutter shape, or other methods known to those skilled in the art. Further, the backup cutter blocks may be devoid of cutters for "backreaming," or underreaming while pulling the drilling apparatus out of the wellbore. As such, the backup cutter blocks 132 may be smaller than the primary cutter blocks 130. Embodiments of the present disclosure relate to an activation system within drilling apparatus 100 that allows primary cutter blocks 130 and backup cutter blocks 132 to be selectively activated downhole depending upon the characteristics of the formation being drilled.

Figure 1B:
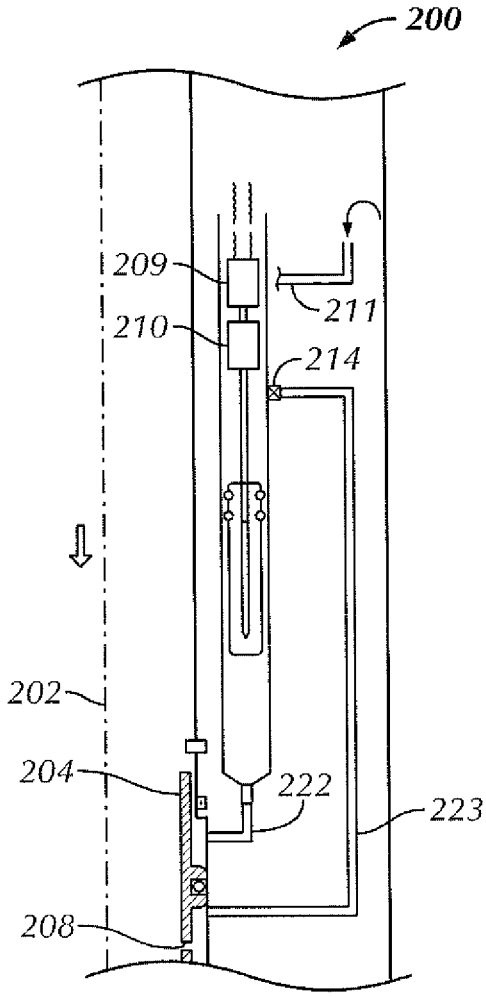
FIG. 1B is a cross-section view of components of an activation system in the drilling apparatus in accordance with embodiments of the present disclosure.

Referring now to FIG. 1B, a schematic view of an upper portion of an activation system 200 in the drilling apparatus is shown in accordance with embodiments of the present disclosure. Activation system 200 includes a pump 210 that is coupled to a motor 209 in the drilling apparatus. Pump 210 uses fluid stored in a reservoir 211 to operate a main sleeve 204 in upward and direction directions. A toggle switch 214 may be used to route fluid to a sleeve activation-down port 222 and a sleeve activation-up port 223. As used herein, the toggle switch may be defined as a valve to control the direction of fluid from the pump either to the sleeve activation-down port 222 or the sleeve activation-up port 223. Toggle switch 214 may be electronically connected to pump 210 and configured to toggle each time pump 210 is stopped. Further, the various components (e.g., pump 210, motor 209, fluid reservoir 211, and toggle switch 214) may be disposed in a wall of the main body of the drilling apparatus at a location substantially proximate main sleeve 204. Those skilled in the art will understand any number of electric pumps may be used. For example, in select embodiments, a pump supplied by Bieri Swiss Hydraulics may be used. Further, in select embodiments, a DC motor supplied by MicroMo Electronics may be used; however, those skilled in the art will understand any number of electric motors may be suitable. Depending on the direction in which the fluid is routed, main sleeve 204 having an activation port 208 may be operated, the position of which determines which cutter blocks (primary or backup) are expanded. The following figures illustrate the sequence of operation of actuating the primary and backup cutter blocks while downhole.

Figure 2A:
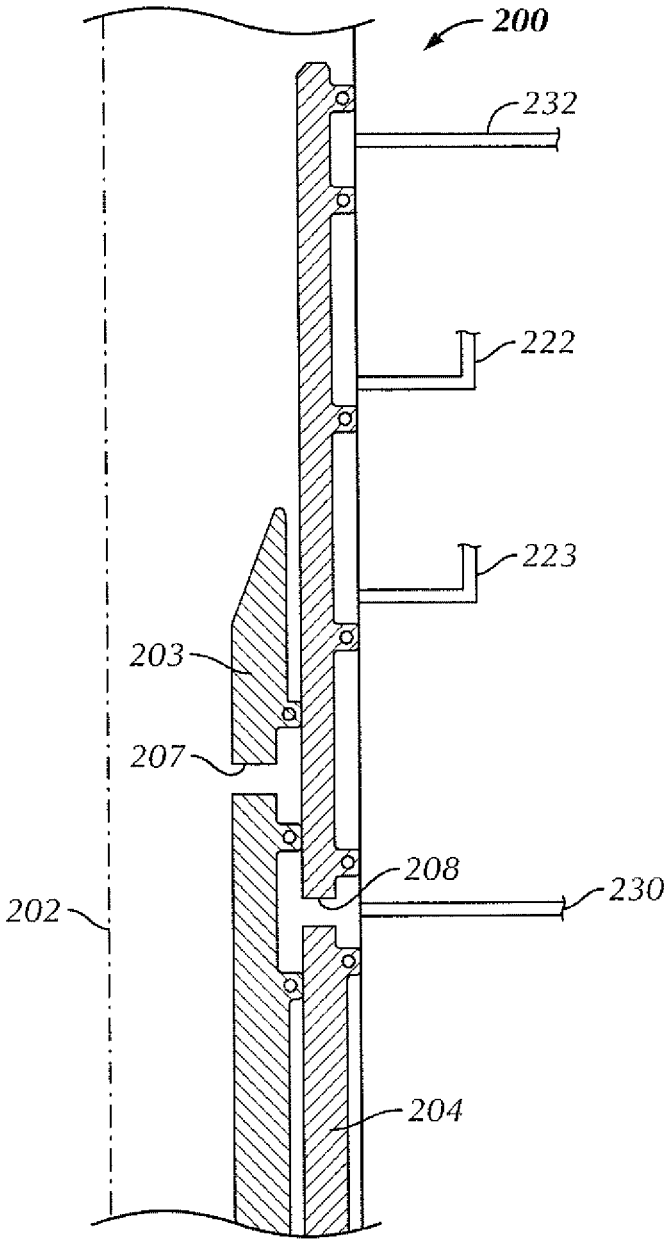
FIG. 2A is a cross-section view of a main sleeve of the activation system in the drilling apparatus in a run-in hole condition with primary and backup cutter blocks collapsed in accordance with embodiments of the present disclosure.
Figure 2B:
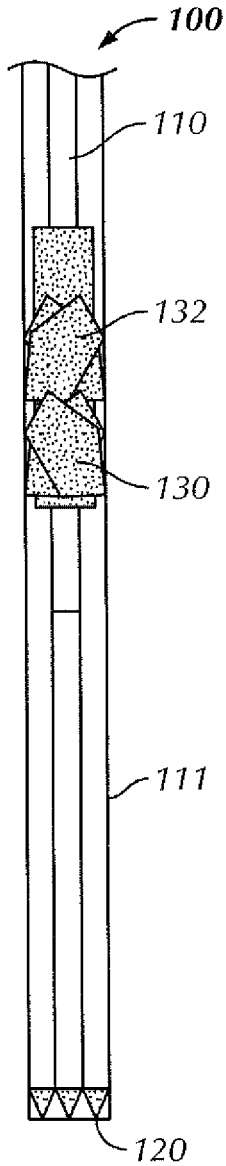
FIG. 2B is a cross-section view of the drilling apparatus in a run-in hole condition in accordance with embodiments of the present disclosure.

Referring now to FIGS. 2A and 2B, cross-section views of activation system 200 of the drilling apparatus 100 in a "run-in hole" condition are shown in accordance with embodiments of the present disclosure. As previously shown in FIG. 1B, activation system 200 includes activation ports 222 and 223 which receive fluid from the reservoir 211 through pump 210 (FIG. 1B) to operate main sleeve 204. Sleeve activation-down port 222 provides fluid to move main sleeve 204 in a downward direction, while sleeve activation-up port 223 provides fluid to move main sleeve 204 in an upward direction. Activation system 200 also includes primary cutter block activation port 230 (to expand primary cutter block) and backup cutter block activation port 232 (to expand backup cutter block). Main sleeve 204 includes a main sleeve activation port 208 configured to align with primary cutter activation port 230 and a ball-drop sleeve activation port 207 in a ball-drop sleeve 203. Ball-drop sleeve 203 is disposed radially inward of main sleeve 204. As shown, the drilling apparatus may be configured in a run-in hole condition in which the main sleeve activation port 208 and ball-drop sleeve activation port 207 are not aligned, thus the primary cutter block activation port 230 is closed. Further, the backup cutter block activation, port 232 is covered by the main sleeve 204, and thus, is also closed. Therefore, both primary and backup cutter blocks are in a retracted position as the drilling apparatus is inserted into the borehole and run downhole, as shown in FIG. 2B.

Figure 3A:
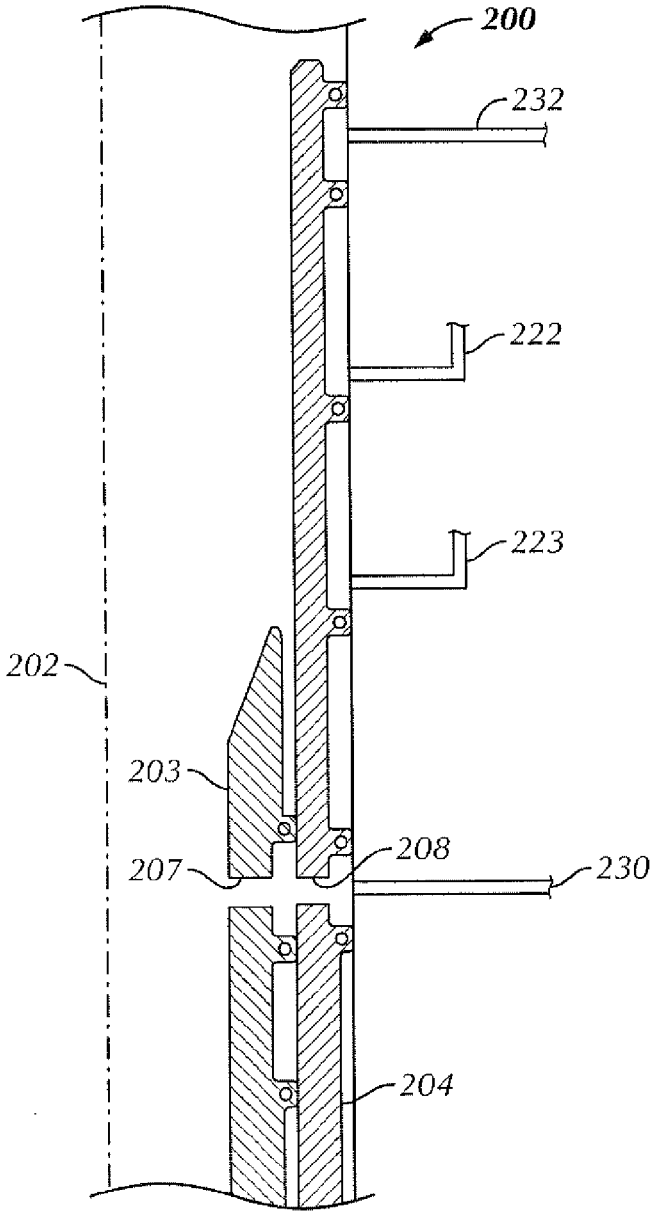
FIG. 3A is a cross-section view of a main sleeve of the activation system in the drilling apparatus with primary cutter blocks expanded and backup cutter blocks collapsed in accordance with embodiments of the present disclosure.
Figure 3B:
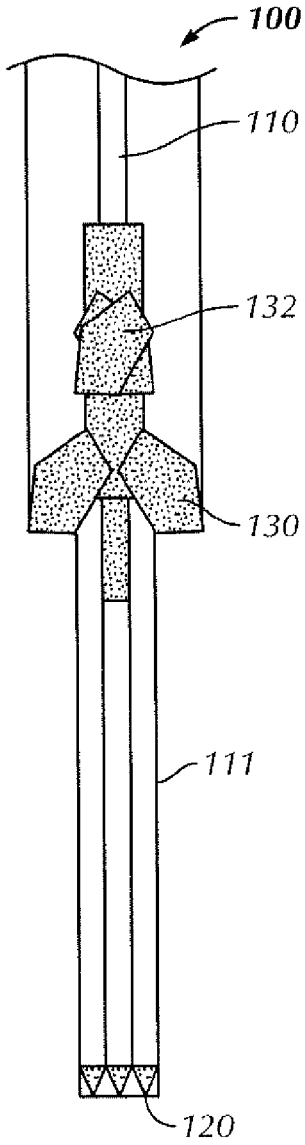
FIG. 3B is a cross-section view of the drilling apparatus with the primary cutter blocks expanded and backup cutter blocks collapsed in accordance with embodiments of the present disclosure.

Referring to FIGS. 3A and 3B, cross-section views of activation system 200 of the drilling apparatus are shown in which the activation system 200 is configured to expand the primary cutter blocks 130 (FIG. 3B) in accordance with embodiments of the present disclosure. Initially, shear pins (not shown), which fixes the ball-drop sleeve 203 and the main sleeve 204 relative to each other, are sheared due to an increased hydraulic pressure after a ball drop to move the ball-drop sleeve 203 downward and align ball-drop activation port 207 with main sleeve activation port 208. Ball-drop devices are well known in the art and will not be described in detail. Once the ball-drop activation port 207 and the main sleeve activation port 208 are aligned, fluid is able to flow into the primary cutter block activation port 230 and expand primary cutter blocks 130, as shown in FIG. 3B.

Figure 3C:
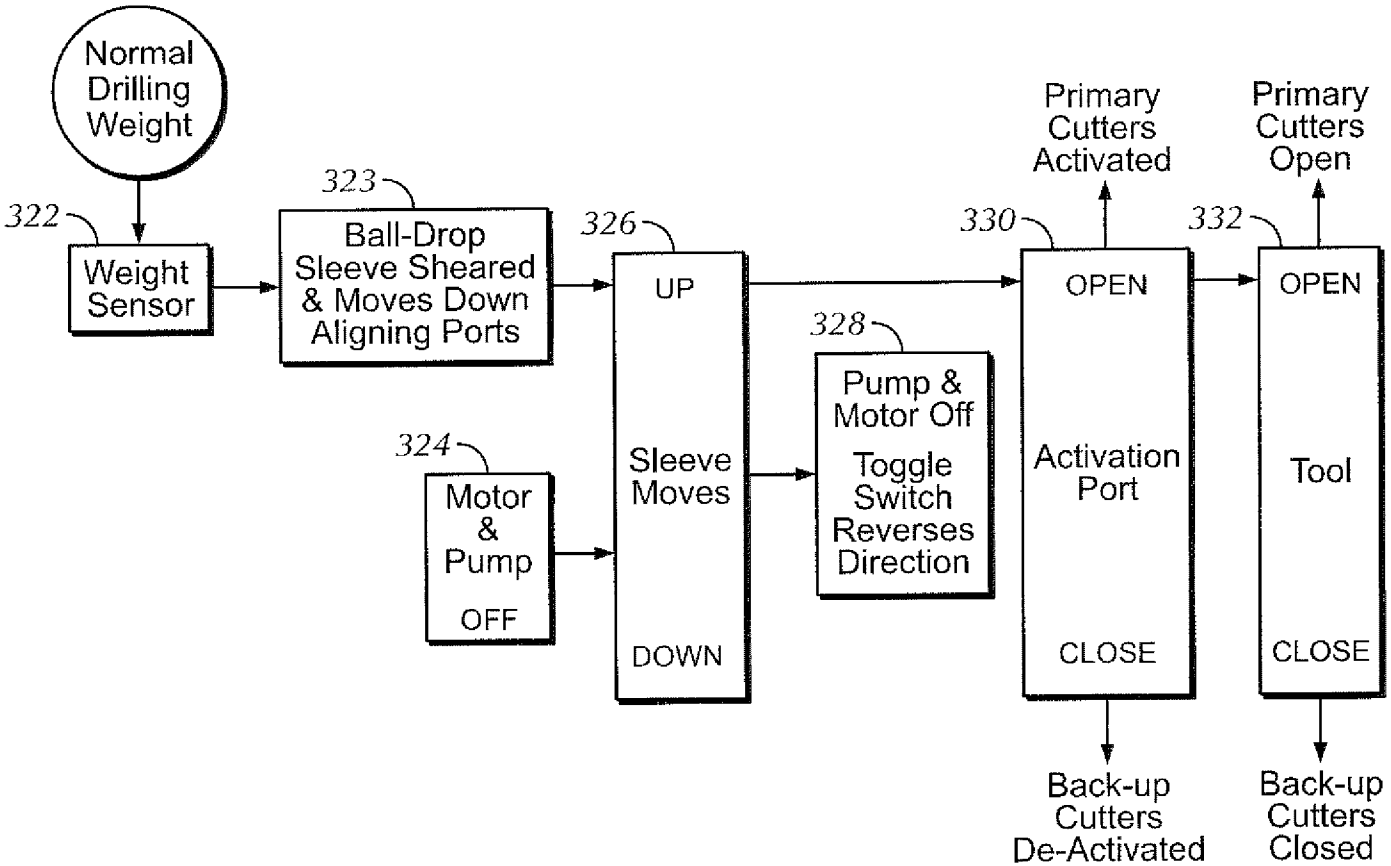
FIG. 3C is an operation sequence of the activation system shown in FIG. 3A in accordance with embodiments of the present disclosure.

FIG. 3C shows an operation sequence of the activation system 200 shown in FIGS. 3A and 3B in accordance with embodiments of the present disclosure. When the pilot hole is drilled and the borehole is to be enlarged, the primary cutter blocks are activated by a ball-drop device 323. The main sleeve is initially in an "up" position in the bore 326, therefore as described above, when after the ball drop device shears the shear pins, activation ports in the ball drop sleeve and the main sleeve are aligned. This allows the primary cutter blocks to expand, while the backup cutter blocks remain collapsed. The motor and pump remain off initially 324, 328. The drilling operation continues with the primary cutter block activation port open 330 and the primary cutter blocks expanded 332 to enlarge the borehole.

While enlarging the borehole, weight sensors (not shown) of the activation system monitor the weight applied on the primary cutter blocks. To reduce premature wear on the primary cutter blocks, the backup cutter blocks may be expanded and the primary cutter blocks collapsed when the drilling apparatus enters a harder formation. The weight sensors may detect an increased weight applied on the primary cutter blocks and send a signal to operate the activation system by turning on the pump and moving the main sleeve. Normal underreaming operations, for the purposes of embodiments disclosed herein, are typically run with weight on the primary cutter blocks that is about 20-25% of the weight on bit ("WOB"). In embodiments disclosed herein, the weight sensor (e.g., a load cell) may detect a weight applied to the primary cutter blocks of at least about 35% WOB before the system is activated and the backup cutter blocks are expanded. One of ordinary skill in the art will appreciate that other preset limits may be used in accordance with embodiments of the present disclosure. Operation of the activation after the preset weight limit is reached proceeds as follows.

Figure 4A:
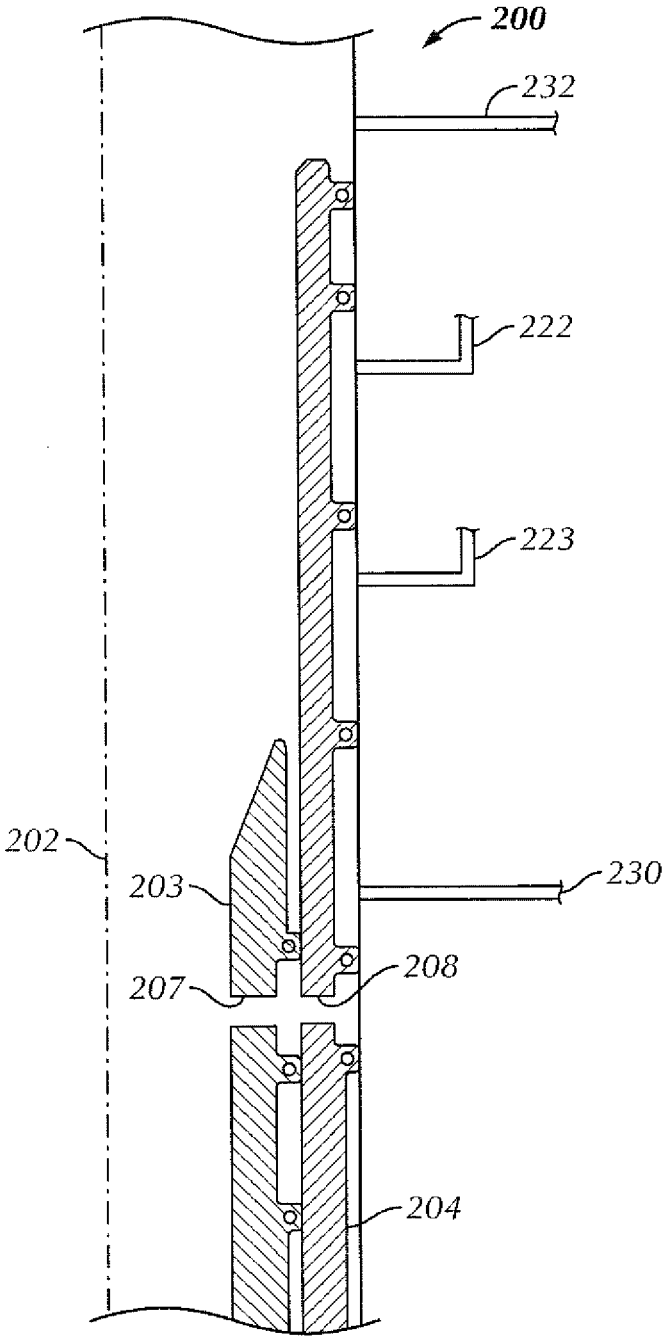
FIG. 4A is a cross-section view of a main sleeve of the activation system in the drilling apparatus with backup cutter blocks expanded and primary cutter blocks collapsed in accordance with embodiments of the present disclosure.
Figure 4B:
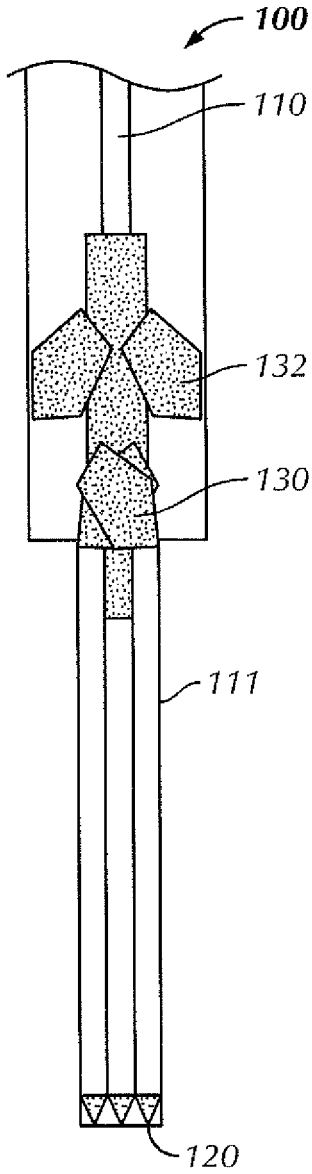
FIG. 4B is a cross-section view of the drilling apparatus with the backup cutter blocks expanded and primary cutter blocks collapsed in accordance with embodiments of the present disclosure.

Referring now to FIGS. 4A and 4B, cross-section views of activation system 200 of the drilling apparatus are shown in which the activation system 200 is configured to expand backup cutter blocks 132 and retract primary cutter blocks 130 in accordance with embodiments of the present disclosure. Main sleeve 204 is moved in a downward direction by providing fluid through sleeve activation-down port 222 and evacuating fluid from sleeve activation-up port 223. Moving the main sleeve 204 downward covers and seals the primary cutter block activation port 230, which collapses the primary cutter blocks (130 in FIG. 4B), and exposes the backup cutter block activation port 232 to allow fluid to enter and expand the backup cutter blocks 132.

Figure 4C:
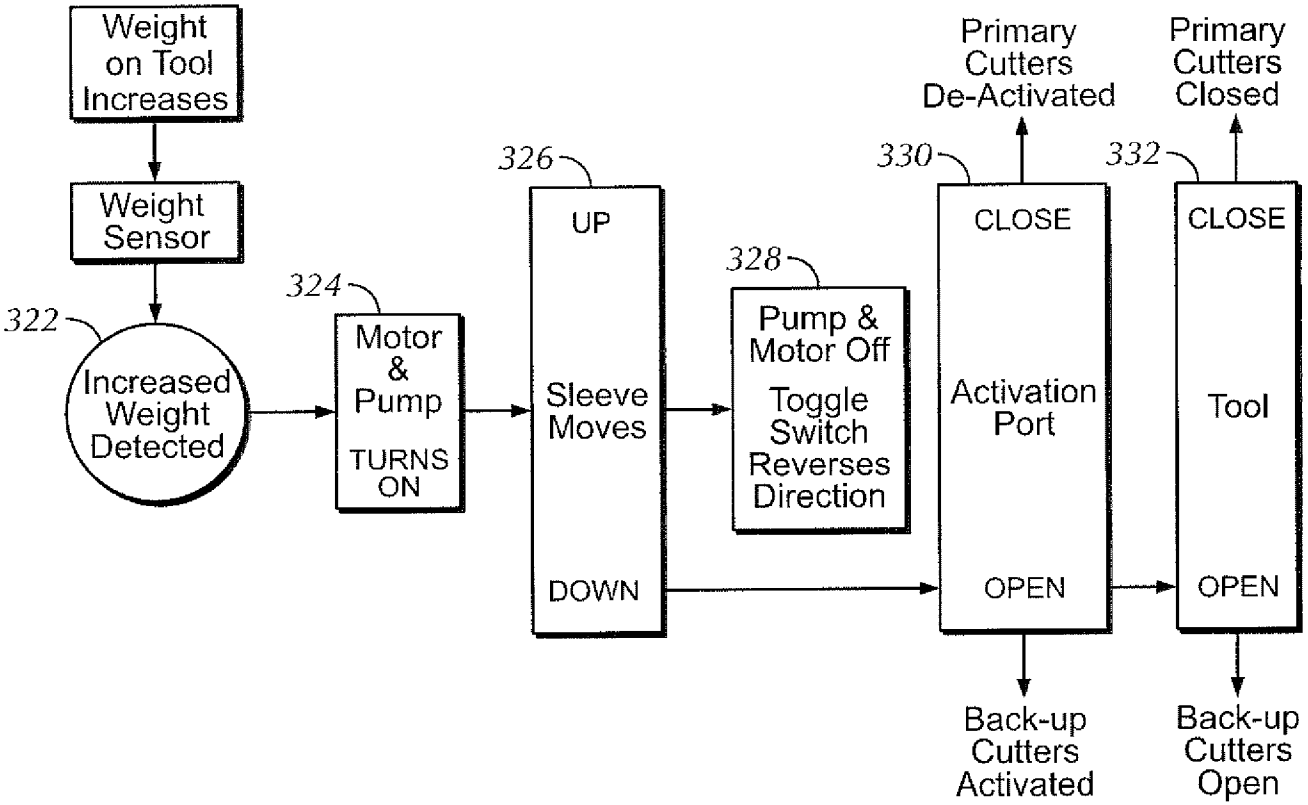
FIG. 4C is an operation sequence of the activation system shown in FIG. 4A in accordance with embodiments of the present disclosure.

FIG. 4C shows an operation sequence of the activation system 200 shown in FIGS. 4A and 4B in accordance with embodiments of the present disclosure. When a weight sensor in the primary cutter blocks detects an increased weight above a preset limit 322 (which indicates the cutter blocks are in a harder formation), the coupled motor and pump may be turned on 324 to activate the main sleeve. The main sleeve is moved downward 326 to expand the backup cutter blocks (by exposing the backup cutter block activation port 232 of FIG. 4A). The coupled motor and pump may be turned off 328 and the drilling operation may continue with the backup cutter block activation port open (primary cutter block activation port closed) 330 and the backup cutter blocks expanded while the primary cutter blocks are collapsed 332.

While operating with the backup cutter blocks expanded, a second weight sensor disposed on or near the backup cutter blocks may monitor the weight applied to the backup cutter blocks. Upon sensing that the weight on the backup cutter blocks has decreased below the prescribed limit (e.g., the weight on the backup cutters is less than 35% WOB), the activation system may be activated to collapse the backup cutter blocks 132 and expand the primary cutter blocks and continue the operation.

Figure 5A:
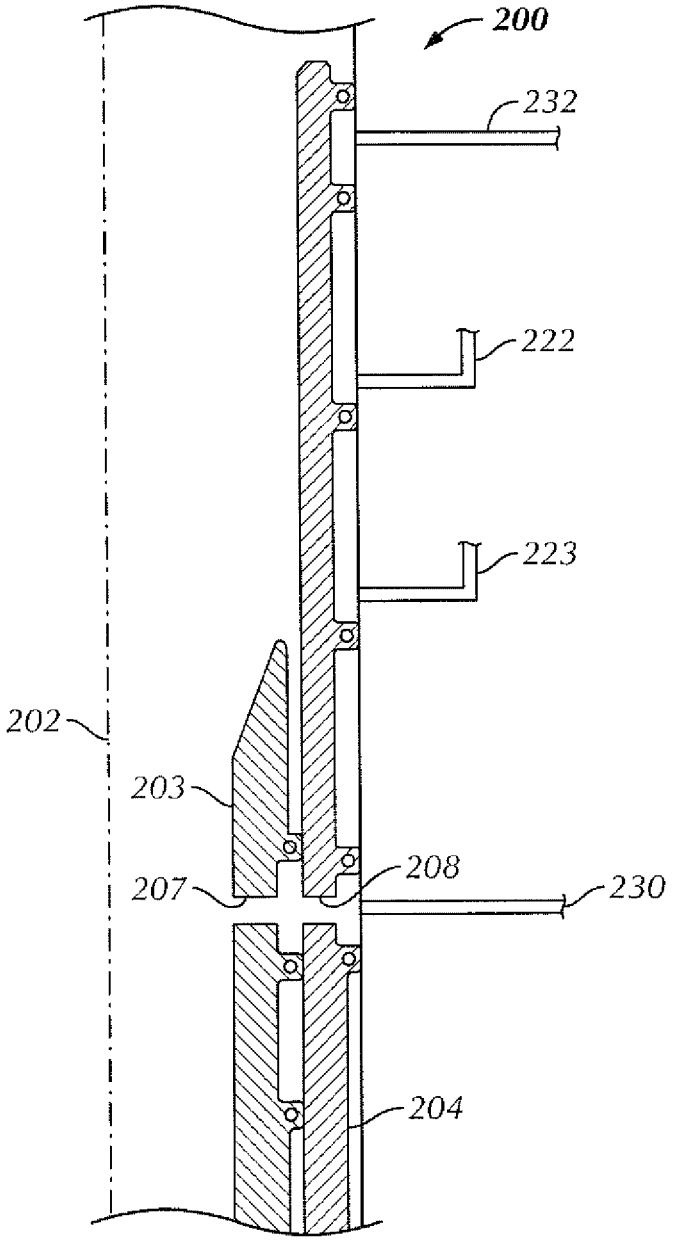
FIG. 5A is a cross-section view of a main sleeve of the activation system in the drilling apparatus with primary cutter blocks returned to an expanded position and backup cutter blocks collapsed in accordance with embodiments of the present disclosure.
Figure 5B:
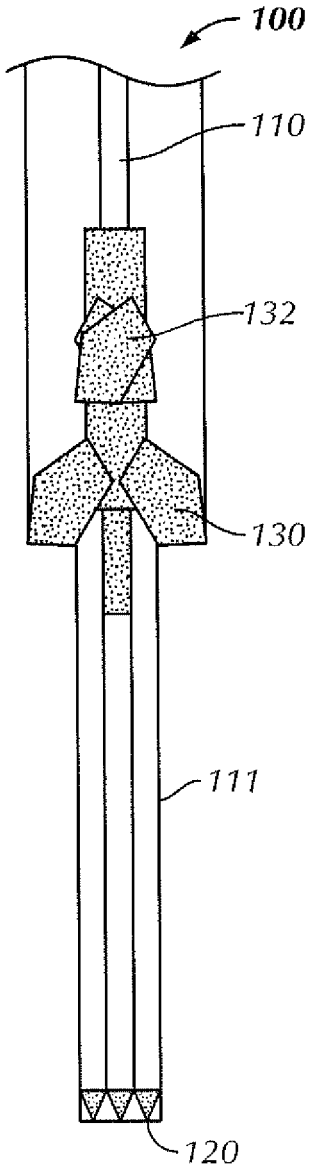
FIG. 5B is a cross-section view of the drilling apparatus with the primary cutter blocks returned to an expanded position and backup cutter blocks collapsed in accordance with embodiments of the present disclosure.

Referring to FIGS. 5A and 5B, cross-section views of activation system 200 of the drilling apparatus are shown in which the activation system 200 is configured to expand the primary cutter blocks and collapse the backup cutter blocks in accordance with embodiments of the present disclosure. Main sleeve 204 is moved in an upward direction by providing fluid through sleeve activation-up port 223 and evacuating fluid from sleeve activation-down port 222. Moving the main sleeve 204 upward covers and seals the backup cutter block activation port 232, which collapses the backup cutter blocks 132 (FIG. 5B), and aligns the ball-drop and main sleeve activation ports 207, 208, respectively, with the primary cutter block activation port 230, which expands the primary cutter blocks 130 (FIG. 5B).

Figure 5C:
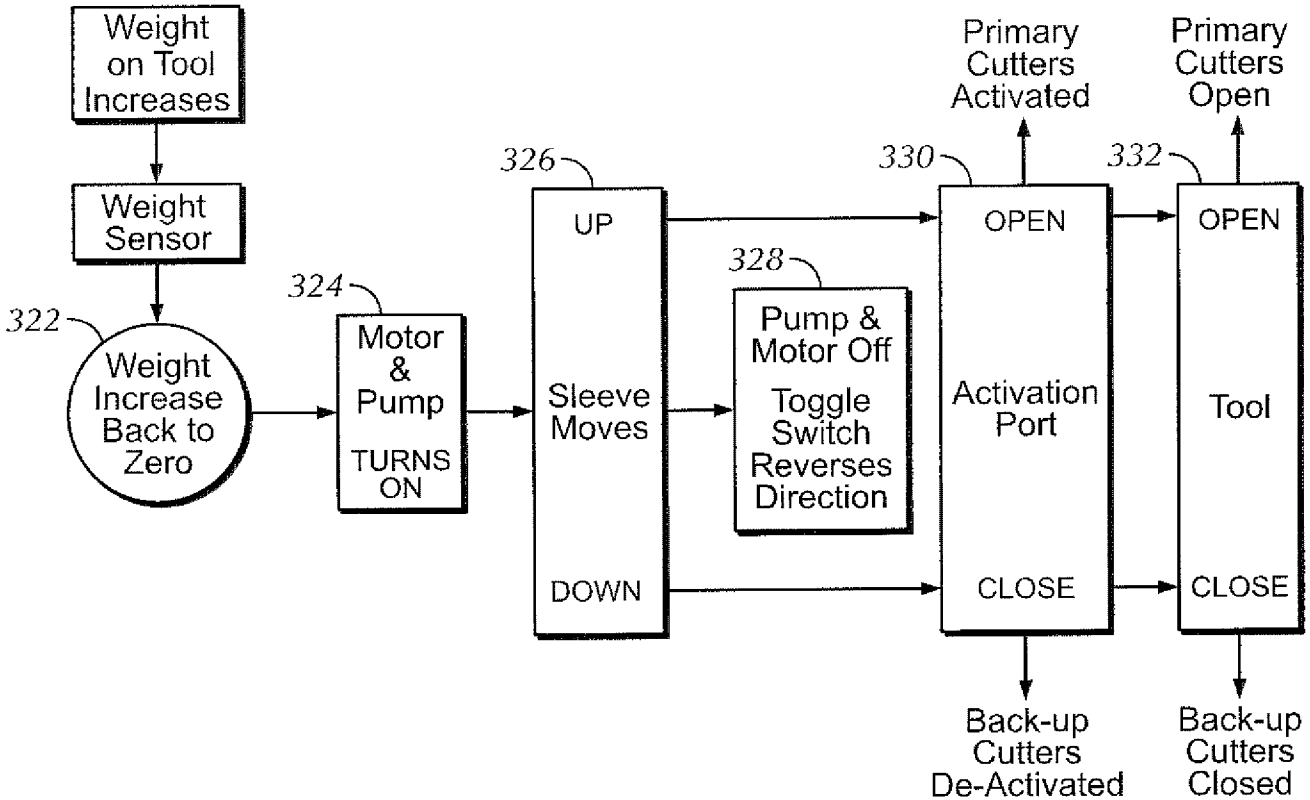
FIG. 5C is an operation sequence of the activation system shown in FIG. 5A in accordance with embodiments of the present disclosure.

FIG. 5C shows an operation sequence of the activation system shown in FIGS. 5A and 5B in accordance with embodiments of the present disclosure. When the weight sensor disposed on the backup cutter blocks detects a decreased weight below the preset weight limit 322, a signal may be sent to operate the coupled motor and pump 324 and move the main sleeve upward 326 to collapse the backup cutter blocks and expand the primary cutter blocks. After the main sleeve is moved fully upward, the coupled motor and pump are shut off 328 and the drilling operation continues with the primary cutter block activation port open (backup cutter block activation port closed) 330 and the primary cutter blocks expanded while the backup cutter blocks are collapsed 332.

Advantageously, embodiments of the present disclosure may provide a drilling apparatus capable of adapting to real-time information provided by the weight sensors as to the hardness of the formation. As previously described, prior art cutter blocks require that formation intervals with a particularly increased hardness be identified before beginning the drilling operation. This can be characterized as an "open loop" system because the initial formation data is the only information available once drilling starts. Open loop systems are hindered by a change in plans (i.e., drilling in a direction not previously foreseen) and are unable to adapt on the fly. These limitations add considerable cost to the operation both in prep-work prior to drilling and in contingency costs if the drilling operation deviates from the original plan.

In contrast, the embodiments disclosed herein provide a closed loop system that continuously receives feedback on the current properties of the formation (i.e., the formation hardness) as drilling progresses. This eliminates the need for a preliminary "mapping" operation to find intervals with increased hardness. Additionally, a deviation in the drilling operation is easily accommodated because of the closed loop system's ability to provide feedback on the most current formation conditions. Costs may be drastically reduced and conveyed to the customer.

Further, embodiments disclosed herein provide a drilling apparatus capable of maintaining a more constant rate of penetration ("ROP") regardless of the hardness of the material through which the drilling apparatus is passing. With only one set of cutter blocks, often the ROP must be decreased in harder material to reduce premature wear of the cutters. In contrast, embodiments disclosed herein provide heavy duty backup cutter blocks to be used in harder formations, thereby allowing the ROP to be maintained. This leads to faster and more efficient drilling and underreaming operations, saving the customer valuable money and rig time.

Moreover, embodiments of the present disclosure allow the bit and the cutter blocks to be used comparatively for the same length of time. It may be detrimental to have one component (i.e., the bit) outlast the other component (i.e., the cutter blocks) because then the drilling apparatus must be "tripped out" of the wellbore more often to replace parts. However, embodiments disclosed herein substantially reduce the chance that the bit will outlive the cutter blocks, thereby reducing tripping costs. Finally, embodiments disclosed herein provide redundancy to the drilling apparatus, which is beneficial to reduce costs (i.e., if the primary cutter blocks fail, the backup cutter blocks may be used to complete the job thereby reducing the amount of tripping).

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A drilling apparatus comprising:

a tubular body including an upper connection configured to attach to a drillstring, a lower connection coupled with a drill bit, and an axial borehole therethrough;

primary cutter blocks coupled to the tubular body and configured to selectively expand radially therefrom;

backup cutter blocks coupled to the tubular body and configured to selectively expand radially therefrom; and an activation system, which in response to changes in weight on the primary and backup cutter blocks, is configured to:

expand the primary cutter blocks and collapse the backup cutter blocks in a first operation sequence; and collapse the primary cutter blocks and expand the backup cutter blocks in a second operation sequence.

2. The drilling apparatus of claim 1, wherein the backup cutter blocks are configured to cut harder formations relative to the primary cutter blocks.

3. The drilling apparatus of claim 1, wherein the backup cutter blocks are devoid of cutters for backreaming.

4. The drilling apparatus of claim 1, further comprising at least one sensor configured to detect weight applied to at least one of the primary and secondary cutter blocks.

5. The drilling apparatus of claim 4, further comprising:

a first sensor configured to detect weight applied to the primary cutter blocks; and a second sensor configured to detect weight applied to the backup cutter blocks.

6. The drilling apparatus of claim 5, wherein the activation system is configured to expand the backup cutter blocks and collapse the primary cutter blocks when the first sensor on the primary cutter blocks detects a weight of at least about 35% of a weight on the drill bit.

7. The drilling apparatus of claim 6, wherein the activation system is configured to collapse the backup cutter blocks and expand the primary cutter blocks when the second sensor on the backup cutter blocks detects a weight of less than about 35% of a weight on the drill bit.

8. The drilling apparatus of claim 1, wherein the primary and backup cutter blocks are configured to be in a retracted position as the drilling apparatus is inserted into the borehole and run downhole.

9. The drilling apparatus of claim 8, further comprising a main sleeve;

a ball-drop sleeve; and a shear pin configured to maintain a position of the main sleeve relative to the ball-drop sleeve, the shear pin configured to shear in response to an increase in hydraulic pressure thereby allowing the ball-drop sleeve to move and align a ball-drop activation port with a main sleeve activation port so as to provide a fluid flow to a primary cutter block activation port.

10. The drilling apparatus of claim 1, further comprising a switch or valve to toggle a direction of fluid flow to either a sleeve activation-down port or a sleeve activation-up port.

11. The drilling apparatus of claim 10, wherein the switch or valve is configured to toggle the direction of fluid flow each time a motor or pump electronically coupled to the switch or valve is shut off.

12. A method of selectively activating cutter blocks in a drilling apparatus, the drilling apparatus having a tubular body with an axial borehole therethrough, the method comprising:

expanding primary cutter blocks;

detecting an increased weight applied to the primary cutter blocks;

collapsing the primary cutter blocks; and expanding backup cutter blocks;

detecting a reduced weight applied to the backup cutter blocks;

collapsing the backup cutter blocks; and expanding primary cutter blocks;

wherein the expanding and contracting of the primary and backup cutter blocks is performed with a closed loop control system based on the detected increased applied weight and the detected reduced applied weight.

13. The method of claim 12, further comprising inserting the drilling apparatus into the borehole and running the apparatus downhole with both the primary and backup cutters in a retracted position.

14. The method of claim 13, further comprising shearing a shear pin thereby allowing a ball-drop sleeve to move and align a ball-drop activation port with a main sleeve activation port, and providing a fluid flow to a primary cutter block activation port.

15. The method of claim 12, further comprising toggling a direction of a fluid flow to selectively expand and contract the primary and backup cutter blocks in response to the detected increased applied weight and the detected decreased applied weight.

16. A method of enlarging a borehole drilled by a bit, the method comprising:

inserting a drilling apparatus in the borehole wherein the drilling apparatus comprises a tubular body, primary cutter blocks, backup cutter blocks, and a drill bit;

rotating the drill string and applying a weight on the drill bit; and alternatingly expanding the primary cutter blocks and the backup cutter blocks in response to a detected weight applied to at least one of the primary cutter blocks and the backup cutter blocks, such that the primary cutter are expanded when the backup cutter blocks are collapsed, and the primary cutter blocks are collapsed when the backup cutter blocks are expanded.

17. The method of claim 16, wherein the detected weight is in a range from about 20% to about 35% of the weight on the drill bit.

18. The method of claim 16, wherein the alternatingly expanding comprises:

expanding the backup cutter blocks and collapsing the primary cutter blocks when the detected weight is above a preset weight limit in the range from about 20% to about 35% of the weight on the drill bit; and collapsing the backup cutter blocks and expanding the primary cutter blocks when the detected weight is below a preset weight limit in the range from about 20% to about 35% of the weight on the drill bit.

* * * * *